US007703579B2

(12) United States Patent
Tyni et al.

(10) Patent No.: US 7,703,579 B2
(45) **Date of Patent: *Apr. 27, 2010**

(54) POSITIONING METHOD IN AN ELEVATOR SYSTEM

(75) Inventors: Tapio Tyni, Hyvinkaa (FI); Pekka Perala, Kerava (FI); Nils-Robert Roschier, Vantaa (FI); Simo Makimattila, Espoo (FI)

(73) Assignee: Kone Corporation, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 12/345,331

(22) Filed: Dec. 29, 2008

(65) Prior Publication Data

US 2009/0166133 A1 Jul. 2, 2009

Related U.S. Application Data

(62) Division of application No. 12/026,406, filed on Feb. 5, 2008, now Pat. No. 7,484,598.

(51) Int. Cl.
*B66B 3/00* (2006.01)
*B66B 5/02* (2006.01)

(52) U.S. Cl. ..... 187/393; 187/291; 187/316

(58) Field of Classification Search ..... 187/277, 187/284, 291, 293, 301, 303, 313, 316, 391–394
See application file for complete search history.

(56) References Cited

U.S. PATENT DOCUMENTS

| | | | |
|---|---|---|---|
| 4,750,591 | A | 6/1988 | Coste et al. |
| 4,880,082 | A | 11/1989 | Kahkipuro et al. |
| 4,930,604 | A | 6/1990 | Schienda et al. |
| 5,760,350 | A | 6/1998 | Pepin et al. |
| 5,780,787 | A | 7/1998 | Kamani et al. |
| 5,864,104 | A | 1/1999 | Tawada et al. |
| 6,854,565 | B2 | 2/2005 | Perala et al. |
| 7,073,632 | B2 | 7/2006 | Martin |

(Continued)

FOREIGN PATENT DOCUMENTS

| | | | |
|---|---|---|---|
| JP | 6-247647 | A | 9/1994 |

(Continued)

*Primary Examiner*—Jonathan Salata
(74) *Attorney, Agent, or Firm*—Birch, Stewart, Kolasch & Birch, LLP

(57) ABSTRACT

A method and a system for the positioning of the elevator car and the door of the elevator in the condition monitoring system are provided. In the method the accelerations of the elevator car and the door of the elevator are measured with a sensor. By integrating the acceleration information two times in relation to time the position information is determined. When the condition monitoring system detects a fault, forecasts a malfunction occurring in the future or detects a significant change in the operation of the elevator or in the measuring signals related to the elevator, it is possible to attach to this information the location of the fault or event i.e. the position of the elevator or the position of a door of a certain floor level on the slide path. The position information can be synchronized to a separate reference point by means of a positioned switch by making an adjustment to the position information at the reference point. The measuring error caused by the misalignment of the position of the sensor is compensated for either with electronics or using a program.

45 Claims, 1 Drawing Sheet

Figure 1:
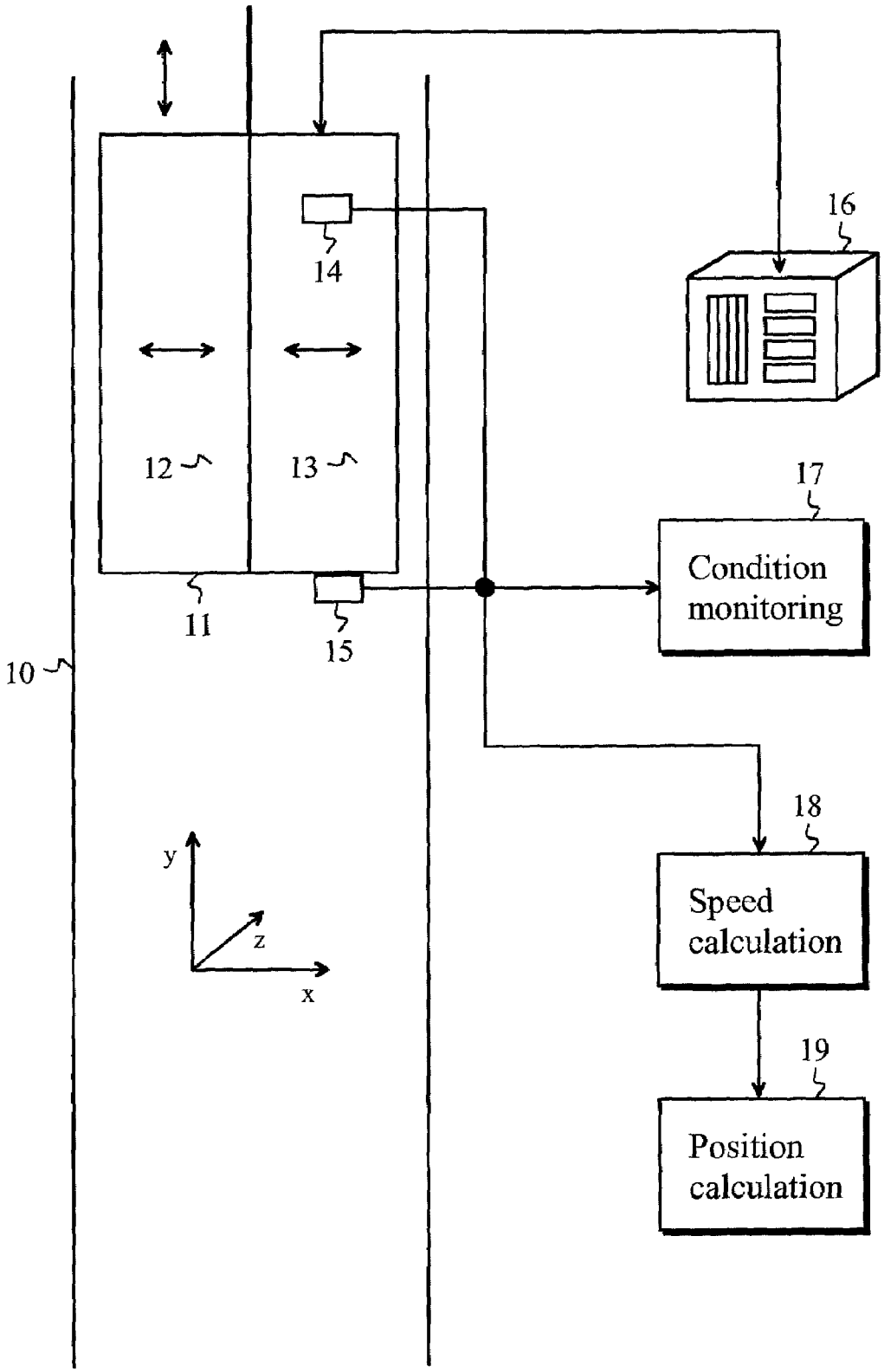

U.S. PATENT DOCUMENTS 7,484,598 B2 * 2/2009 Tyni et al. ..... 187/393

FOREIGN PATENT DOCUMENTS

JP 8-239179 A 9/1996
JP 10-231070 A 9/1998
JP 2003-112862 A 4/2003
WO WO-03/033388 A1 4/2003
WO WO-2005/073119 A2 8/2005
WO WO-2006/035101 A2 4/2006

* cited by examiner

POSITIONING METHOD IN AN ELEVATOR SYSTEM

This application is a Divisional of application Ser. No. 12/026,406 filed on Feb. 5, 2008, now U.S. Pat. No. 7,484,598 and for which priority is claimed under 35 U.S.C. §120; and this application claims priority of Application No. 20050842 filed in Finland on Aug. 19, 2005 under 35 U.S.C. §119; the entire contents of all are hereby incorporated by reference.

FIELD OF THE INVENTION

The present invention relates to the condition monitoring of an elevator system.

BACKGROUND OF THE INVENTION

An elevator system contains many moving and rotating parts, which are prone to malfunction. Parts can wear, they can be incorrectly installed, parts mounted in their intended position can move out of their position and movement subjects the parts to harmful vibration.

For this reason condition monitoring is needed in an elevator system, so that a malfunction can be predicted and so that a reaction can be effected before the fault itself appears and in the worst case stops the elevator.

The purpose of condition monitoring is to detect both changes that occur slowly and sudden deviations in the operation of a measuring device compared to earlier operation that is known to be normal. A condition monitoring appliance can also create a forecast or calculate the probability at a given moment for the occurrence of malfunction of a part of a device or a system. A condition monitoring appliance can also specify the optimal scheduling of servicing procedures or repair procedures. Without a special condition monitoring appliance it is possible to react to unusual operation of the system only after a fault has appeared and operation of the system has in the worst case been interrupted. With a condition monitoring appliance it is possible to react just before the malfunction or in the best case in good time before a malfunction would occur. By means of a condition monitoring appliance a special servicing procedure needed by the system can be scheduled in conjunction with a normal service visit.

Detecting faults and forecasting the malfunction of a device is called fault diagnostics. In fault diagnostics it is prior-art to measure phenomena caused by rotating parts such as vibration, noise, acoustic emissions and changes in stresses. These type of changes that occur over a long time span can be described as time series such that alarm limits can be set for measured magnitudes or for the magnitudes calculated for them, based on which it is possible to deduce the malfunction of a device occurring immediately or in the near future. In fault diagnostics prior-art methods also include the measurement of wear and the measurement of a change caused as a result of corrosion, wear or other use. The aforementioned phenomena for their part indirectly affect the functions of the device.

A condition monitoring system produces data about the functions of the elevator based on measurements. The essential functions to be measured are the timing of the operating cycle of the elevator, the number of starts from the different floors, the number of door re-openings, vibration of the elevator car and the door, friction on the door, noise levels at different stages of the operating cycle and parameters relating to ride comfort such as changes in the acceleration of the car.

For elevators a to-and-fro motion of the car occurring in one direction (a so-called translation motion) is characteristic, which differs from the operation of many machines and appliances. Additionally, the horizontal motion of the doors is characteristic for elevators. Operation is by its nature cyclical.

The changes detected by condition monitoring of elevators in the operation of the parts of the elevator system can occur over a long time span quite slowly.

The vertically moving car and the horizontally opening and closing car doors and landing doors function as the most important moving parts of an elevator system. In the condition monitoring of an elevator it is essential that a deviation detected in some measured magnitude can be connected to the correct floor or to the location of the car in the elevator shaft.

Patent application FI20040104 discusses the condition monitoring of an automatic door e.g. in an elevator system. A dynamic model is created for the door, by means of which the frictional force exerted on the door is ascertained. From the magnitude of the frictional force, for its part, even a small disorder in the movement of the door and malfunction possibly preventing the operating capability of the door as a consequence can be seen.

Patent specification U.S. Pat. No. 5,476,157 presents an elevator control system, wherein the travel of the elevator car is monitored and controlled. The system comprises sensors monitoring each door of the floor levels, with which an open door is detected. Monitoring switches are also disposed at the landings, by means of which the floor location of the elevator car can be deduced. In the method movement of the elevator car is prevented in a situation in which one of the landing doors is open.

Publication JP2003112862 examines the vibrations of an elevator car. The acceleration of a vibration is determined with a detector. The acceleration data is controlled with an analyzer, in which the quality of ride comfort detected in the elevator car is deduced.

Publication JP2000313570 describes an elevator solution without machine room. Pulse transducers are situated in the system such that the motion data of the elevator is measured by means of the pulses transmitted. From this pulse data, for its part, the distance moved, the speed of the motion and the acceleration of the motion are generated for the elevator car. The data is utilized in the control of the elevators and in eliminating vibration of the car.

Publication JP9240948 presents a system, which forecasts malfunction of the elevator in advance. In the system numerous magnitudes relating to the elevator are measured, such as the speed of the elevator, acceleration, the speed of arriving at a floor level and the stopping position of the elevator at the floor level. By means of the data deductions are made by comparison with earlier measurement results. If the results differ from earlier ones by certain criteria, the malfunction situation to be forecast is deduced. The type of the forecast malfunction is notified to the user on screen and also to the computer administering the condition monitoring.

Publication JP8104473 investigates the changes occurring in an elevator system before an actual malfunction. The magnitude of a vibration is determined by examining the difference between the desired ideal speed of the car and the actual measured speed of the car. The magnitudes and types of the vibration in three different operating situations are recorded in the memory of the system. These three operating situations are the normal operating mode, the warning mode and the malfunction mode. By comparing the measured data and the data of the memory a possible change in the operation of the system is detected and a malfunction situation can thus be forecast and additional measurements can if necessary be made to verify the malfunction situation.

Publication U.S. Pat. No. 4,128,141 examines the speed of the elevator car as a function of position at a number of monitoring points in the elevator shaft. The measured speed signal is adjusted with a signal that is in proportion to the acceleration signal. By examining the adjusted speed signal malfunction relating to the movement of the car can be detected. In one embodiment of publication U.S. Pat. No. 4,128,141 the speed signal is derived in relation to time in order to achieve an acceleration signal.

In the detection by the condition monitoring appliance of a deviation in the magnitude describing the operation of the system, it is essential that the deviation data can be connected to the exact position of the elevator car in the elevator shaft. In prior-art technology the condition monitoring appliance has examined the data related to the operating situation of elevators at least partly directly from the control system. One problem with prior-art technology is that the location information of the elevator needed by fault diagnostics has not been determined very simply, i.e. additional sensors for measuring the position have been needed. A general condition monitoring appliance that is independent of the elevator system has not been available. Another problem is that in old elevator systems position information is difficult to obtain.

PURPOSE OF THE INVENTION

The purpose of the present invention is to specify the position of the elevator car to the condition monitoring appliance with sufficient precision independently of the control system of the elevator.

SUMMARY OF THE INVENTION

With regard to the characteristic attributes of the present invention reference is made to the claims.

The present invention presents a method for determining the position information of an elevator car for the condition monitoring system of an elevator system. A control system controls the elevators of the elevator system. In prior-art technology the condition monitoring system monitors observed faults and forecasts future faults in the operation of the elevator system by detecting a change in the magnitude measured compared to a long-term value.

In the present invention the acceleration of the elevator car and the door of the elevator is measured with acceleration sensors fixed to them. These sensors can be the same that the condition monitoring system uses. From the accelerations measured the position information of the car and of the door are calculated by integrating the acceleration twice in relation to time. The information detected or forecast by the condition monitoring system concerning a fault can after this be combined with the calculated position information of the fault.

Similarly to the position, also the speed of the elevator car or the door of the elevator is determined by integrating measured acceleration once in relation to time. From the speed information and position information it is possible to determine the status information for both the elevator car and the doors of the elevator. Possible statuses of the elevator car are 'stationary', 'accelerating', 'constant speed' and 'braking'. The statuses of the door of the elevator, for their part, are 'closed', 'opening', 'opened' and 'closing'. In the condition monitoring appliance it is possible to define combinations of these status data, which are in practice impossible from the standpoint of the safety of elevator operation. If the condition monitoring detects such a combination of status data during elevator operation, it is specified that a malfunction situation has occurred or a symptom of malfunction has been detected. This type of symptom therefore will probably result in an actual malfunction, if the situation is not rectified. On the other hand at the time it appears the symptom only means a greater possibility of a future malfunction, and even after detection of the symptom the system can work fully as desired.

The cumulative error developing in the position determination of the system can be corrected at suitable time intervals. This can be done in practice by situating a synchronization switch in some location (a reference point) in the elevator shaft such that the switch closes as the elevator car travels past the switch, and otherwise the switch remains open. When the elevator car closes the switch, the position information of the reference point is set as the position information of the elevator. One reference point of the invention that acts as an example is the position of the elevator on the entrance floor of the building. Before the commissioning of the condition monitoring system the system can be allowed to measure the position data of the different floor levels at each stop, and thus ascertain all the consecutive floor-to-floor distances (which can be of different magnitudes) by comparing the position data and the position information of the reference floor with each other. After this the floor-to-floor distance data can be used by the condition monitoring system.

Since the acceleration sensor cannot be installed in the fully desired position, as a result an error in the measurement of acceleration is caused from the misalignment of the sensor. In the invention this measurement error is compensated for before an integration operation with electronics or after integration using a program.

A microphone can be included in the condition monitoring system, with which acoustic signals caused by the movement of the elevator car or the door of the elevator can be detected. The condition monitoring system can also measure the current or voltage moving the elevator car or the door of the elevator.

In one embodiment of the present invention the calculated position information can be combined with the condition monitoring system in order to detect an event that is significant from the standpoint of the operation of the elevator system. This kind of event does not thus need to be a fault or a symptom of a fault but it can be a sufficiently large change in the operation of the system or in a magnitude of the system measured somewhere although not causing a malfunction situation.

The present invention further comprises a system, which implements the phases of the method according to the present invention. Furthermore the present invention comprises a condition monitoring system, which can be installed as a separate appliance in e.g. a existing elevator systems.

In one embodiment of the present invention the sensors needed by the position information system are installed as separate components i.e. the position information system according to the invention can be connected to an elevator system as a separate functional module or as a separate system.

One advantage of the present invention is that positioning and the measurements of condition monitoring can be done with the same sensors by processing the signal of the sensor and by separating from it the attributes characteristic to elevator operation and the attributes that characteristic in positioning. Another advantage of the present invention is the complete independence from the control system of the elevator as well as easy and quick installation. Furthermore the positioning appliance according to the present invention does not influence the operation of the elevator system itself.

LIST OF FIGURES

FIG. 1 presents one principle according to the present invention for determining position information by means of the condition monitoring appliance of the elevator.

DETAILED DESCRIPTION OF THE INVENTION

In the following one embodiment of the present invention will be presented, in which the position of the elevator car can be determined sufficiently accurately with the same sensors that are used in the condition monitoring of the elevator. The position of the car can be determined independently of the elevator control system used.

FIG. 1 presents the appliance and method according to the present invention. The elevator car 11 moves in the elevator shaft 10 of the building. The doors 12, 13 of the elevator are positioned at the floor levels and in this example the doors 12, 13 are horizontally sliding doors in two parts. Additionally in this example the elevator car 11 is precisely at the position of the floor level. The control system 16, which in practice is a processor that manages the processing of the travel and the calls of the elevators, controls the operation of the elevator system.

The condition monitoring appliance of the system includes numerous sensors and measuring points, which are monitored in the condition monitoring. Movement of the car 11 is monitored with the acceleration sensor 15 and movement of the doors 12, 13 of the car and of the doors of the landings that slide with them is monitored with the acceleration sensors 14. With the acceleration sensors 14, 15 it is also possible to measure horizontal and vertical vibration of the elevator car 11. With the acceleration sensor 14, 15 the acceleration of movement in one direction is measured, so it is possible to influence interpretation of the measured signal with the position of the sensor 14, 15. If the sensor 14, 15 is positioned at an angle e.g. such that there is both an x component and a y component in the measuring direction of the sensor 14, 15, it is possible with the one sensor 14, 15 to measure vibration in both the x direction and the y direction. One alternative is to position a separate sensor for each possible direction of vibration, in which case more accurate results about the motions of the elevator car 11 in the different directions are obtained.

A microphone located inside the car 11 can be included in the condition monitoring, with which the range of noise caused by the travel of the elevator can be detected. The current or voltage of the motor controlling the door 12, 13 can also be measured. With a microphone fixable to the door 12, 13 it is possible to measure especially the noises caused by the friction forces exerted on the door 12, 13. The acoustic emissions detected on the door 12, 13 can also be measured with the sensor.

The condition monitoring appliance 14, 15, 17 must be able to determine the position of the elevator car 11 all the time, so that a deviation in the measured magnitude can be traced to the correct floor or more generally to the actual location of the fault in the elevator shaft 10. The basic idea of the present invention is to use e.g. the information measured by the sensor 15 about the vertical acceleration of the car. By integrating the acceleration once the calculated speed 18 of the elevator car as a function of time is obtained. By integrating the speed obtained a second time the position information 19 of the elevator car 11 is determined, i.e. the position in the elevator shaft 10.

An error occurs in the position information 19 obtained, if the sensor is incorrectly installed. In practice there is always a bias component visible in the position information 19, which must be taken into account in further analysis. Additionally an error occurs and its magnitude accumulates if the definition of the position is not synchronized at adequate intervals to one or more desired fixing points in the elevator shaft 10. A synchronization switch, which is located e.g. on the entrance floor of the building, can function as a fixing point. When the elevator car 11 travels past the switch (the position of which is precisely known) accurately determined position information is obtained after this by comparing the measured position to the position of the reference point. The elevator 11 visits the entrance floor of the building at relatively regular time intervals, so it is natural to select e.g. the entrance floor of the building as the fixing point of synchronization.

In one embodiment of the present invention the acceleration information used in the position information calculation 19 is determined with the same sensors 14, 15 that the condition monitoring 17 of the system uses. Thus no additional appliances are needed in the building or in the elevator system and no new connections need to be made to the elevator's own control system 16 because of this. In a preferred embodiment of the invention the essential parts 17, 18, 19 of the invention are implemented as a separate module, which can be connected to the elevator system and be independent of the control system used. By utilizing the measured accelerations 14, 15 and the calculated speed 18 as well as the position 19 it is possible to define the status of the elevator car 11 and of the doors 12, 13. The possible statuses of the car 11 are 'stationary', 'accelerating', 'constant speed' and 'braking'. The statuses of the doors 12, 13 are, for their part, 'closed', 'opening', 'opened' and 'closing'.

The integration of acceleration two times may cause problems. Errors in the acceleration signal accumulate in the later stages of the calculation i.e. in the calculated speed 18 and the calculated position 19. An error is caused e.g. by the fact that it is never possible to install the acceleration sensors 14, 15 exactly perpendicularly with respect to the measured direction of movement. The sensor also has its own internal measuring error. The position (angle of inclination) of the elevator car 11 in the elevator shaft 10 is also affected by the balancing of the car 11 and the load (number of passengers) of the car 11 according to the moment of examination, the straightness of the guide rails and the location of the car 11 in the shaft 10. The installation angle of the sensor 14, 15 causes a constant error, which can be compensated for either with electronics before digital signal processing or in later processing with a suitable method using a program.

Furthermore in the present invention it is possible to utilize the status data of the car 11 and of the doors 12, 13 at the moment of examination, because all the possible combinations of the statuses of the car 11 and of the doors 12, 13 are not permitted in the elevator system. By cross-use of the status data of the car 11 and of the doors 12, 13 the positioning is adjusted. If the status machines used in the system operate incorrectly for some reason, it is possible with the aforementioned cross-use to rectify the operation so that it is correct. One example of a necessary status adjustment is the forcing of the doors 12, 13 into the 'closed' status when the status of the car 11 is 'accelerating' or 'constant speed'.

Another example of a status adjustment is the forcing of the car 11 into the 'stationary' status when the status of the doors 12, 13 is 'opened' or 'closing'.

The distances between floor levels with respect to a selected reference floor are stored in the memory of the condition monitoring system. It is generally worth selecting the ground floor, i.e. the entrance floor, of the building as the reference. After each trip made by the car 11, when the status of the car 11 has changed from 'braking' status to 'stationary' status, the position 19 calculated by the positioning system of the car 11 is corrected to the exact positioning information of the floor found from the memory. The floor nearest the calculated position information is selected and as a result of this it is sufficient for positioning that at the end of the drive the car 11 arrives at a maximum of half the floor-to-floor distance from the ideal stopping place. In practice the errors are significantly smaller than that mentioned above.

The invention is not limited solely to the examples presented above, but many variations are possible within the scope of the inventive concept specified in the claims.

The invention claimed is:

1. Method for determining the position information of an elevator car for the condition monitoring system of an elevator system, in which a control system controls the elevators of the elevator system, the method comprising:

monitoring the operation of the elevator system with the condition monitoring system, said monitoring including detecting and forecasting malfunction of the elevator system;

wherein said detecting and forecasting include:

measuring the acceleration of the elevator car and of the door of the elevator with an acceleration sensor fixed to the door of the elevator, said sensor being positioned at an angle such that it detects both horizontal and vertical accelerations;

calculating at least one derived magnitude from the measured acceleration; and combining at least one of the derived magnitudes with information about a malfunction or predictable fault situation detected by the condition monitoring system.

2. Method according to claim 1, wherein said calculating at least one derived magnitude comprises:

calculating positions of the elevator car and of the door of the elevator by doubly integrating the measured accelerations of the elevator car and of the door of the elevator.

3. Method according to claim 1, the method further comprising:

calculating the speed of the elevator car by integrating the measured acceleration of the car.

4. Method according to claim 1, the method further comprising:

determining statuses of the elevator car and of the door of the elevator using calculated speed information and position information of the elevator car and of the door of the elevator.

5. Method according to claim 4, wherein the status of the elevator car consists of 'stationary', 'accelerating', 'constant speed' or 'braking', and the status of the door of the elevator consists of 'closed', 'opening', 'opened' or 'closing'.

6. Method according to claim 4, wherein the method further comprises:

specifying that a malfunction has occurred, or that a symptom of malfunction has been detected, and naming the fault or the symptom, when the condition monitoring system detects impossible combinations, from the standpoint of the safety of elevator operation, as being specified for the status data of the elevator car and of the door of the elevator during elevator operation.

7. Method according to, claim 1, the method further comprising:

setting, as the position information of the elevator car in the elevator shaft, a reference point in the shaft where a synchronization switch is positioned when the synchronization switch is triggered by the elevator car.

8. Method according to claim 7, wherein said reference point is the entrance floor of the building.

9. Method according to claim 1, wherein monitoring the operation includes measuring the travel distances between the positions of the floor stops and a reference floor to determine information about floor-to-floor distances.

10. Method according to claim 1, the method further comprising:

compensating for measuring error caused by a misalignment of the position of the acceleration sensor with a compensation circuit before integration or after integration using a program.

11. Method according to claim 1, monitoring the operation further comprising:

detecting acoustic signals caused by the movement of the elevator car or the door of the elevator using a microphone included in the condition monitoring system.

12. Method according to claim 1, monitoring the operation further comprising measuring the current or voltage of the motor moving the elevator car or the door of the elevator.

13. Method according to claim 2, the method further comprising:

combining the calculated position information with a significant event or deviation in the value of a measured magnitude describing the operation of the elevator system detected by the condition monitoring system.

14. An elevator system, the system comprising:

at least one elevator;

a control system that controls the elevators of the elevator system;

a condition monitoring appliance that monitors the operation of the elevator system and detects and forecasts malfunction of the elevator system;

a condition monitoring appliance that monitors the operation of the elevator system and detects and forecasts malfunction of the elevator system;

an acceleration sensor on a door of the elevator, said sensor being positioned at an angle such that it detects both horizontal and vertical accelerations;

a calculation unit that calculates at least one derived magnitude from the measured accelerations; and wherein said condition monitoring appliance combines at least one calculated derived magnitude with the detected information about malfunction or with a forecastable fault situation.

15. System according to claim 14, wherein:

the calculating unit calculates the positions of the elevator car and of the doors of the elevator by doubly integrating the corresponding measured accelerations of the elevator car and of the doors of the elevator.

16. System according to claim 14, wherein the calculator calculates the speed of the elevator car by integrating the measured acceleration of the elevator car.

17. System according to claim 16, wherein said condition monitoring appliance determines the statuses of the elevator car and the door of the elevator using the calculated speed information and position information of the elevator car and the door of the elevator.

18. System according to claim 17, wherein the status of the elevator car consists of 'stationary', 'accelerating', 'constant speed' or 'braking', and the status of the door of the elevator consists of 'closed', 'opening', 'opened' or 'closing'.

19. System according to claim 17, wherein the condition monitoring appliance determines a fault event or detects the symptom of a malfunction, and names the determined fault or the detected symptom of a fault, when, while specifying combinations of the status information of the elevator car and the door of the elevator, said condition monitoring system detects a combination that is impossible from the standpoint of the safety of elevator operation during operation of the elevator.

20. System according to claim 14, wherein the system further comprises:

a synchronization switch situated at a desired reference point in the elevator shaft; where the calculation unit adjusts the position information of the elevator car to the position of the reference point when the elevator car triggers the synchronization switch.

21. System according to claim 20, wherein the reference point is the entrance floor of the building.

22. System according to claim 14, wherein the condition monitoring appliance measures the travel distances between the positions of floor stops and a reference floor, thereby developing information about floor-to-floor distances.

23. System according to claim 14, wherein the system further comprises:

an error compensator that compensates for measurement error caused by misalignment of the position of the acceleration sensor before integration.

24. System according to claim 14, wherein the system further comprises an error compensator that compensates for measurement error caused by misalignment of the position of the acceleration sensor with a compensation circuit before integration or after integration using a program.

25. System according to claim 14, wherein the system further comprises a microphone that detects acoustic signals caused by movement of the elevator car or the door of the elevator.

26. System according to claim 14, wherein the condition monitoring appliance includes a measurement portion that measures the current or the voltage of a motor moving the elevator car or the door of the elevator.

27. System according to claim 14, wherein the control system includes a microprocessor.

28. System according to claim 15, wherein the condition monitoring appliance combines the calculated position information with a significant event or deviation in the value of a measured magnitude describing the operation of the elevator system detected by the condition monitoring appliance.

29. System according to claim 14, wherein the acceleration sensor of the system is installed so as to be separate from the elevator system.

30. Condition monitoring system that determines the position information of an elevator car, the system comprising:

a condition monitoring appliance that monitors the operation of an elevator system and detects and forecasts malfunction of the elevator system;

a condition monitoring appliance that monitors the operation of an elevator system and detects and forecasts malfunction of the elevator system;

an acceleration sensor installed on a door of the elevator, said sensor being positioned at an angle such that it detects both horizontal and vertical accelerations;

a calculator that calculates at least one derived magnitude from the measured accelerations; and wherein said condition monitoring appliance combines at least one calculated derived magnitude with the detected information about malfunction or with a forecastable fault situation.

31. Condition monitoring system according to claim 30, wherein the calculating unit calculates the positions of the elevator car and of the doors of the elevator by doubly integrating the corresponding measured accelerations of the elevator car and of the doors of the elevator.

32. Condition monitoring system according to claim 30, wherein the calculator calculates the speed of the elevator car by integrating the measured acceleration of the elevator car.

33. Condition monitoring system according to claim 30, wherein said condition monitoring appliance determines the statuses of the elevator car and the door of the elevator using the calculated speed information and position information of the elevator car and the door of the elevator.

34. Condition monitoring system according to claim 32, wherein the status of the elevator car consists of 'stationary', 'accelerating', 'constant speed' or 'braking', and the status of the door of the elevator consists of 'closed', 'opening', 'opened' or 'closing'.

35. Condition monitoring system according to claim 32, wherein the condition monitoring appliance determines a fault event or detects the symptom of a malfunction, and names the determined fault or the detected symptom of a fault, when, while specifying combinations of the status information of the elevator car and the door of the elevator, said condition monitoring system detects a combination that is impossible from the standpoint of the safety of elevator operation during operation of the elevator.

36. Condition monitoring system according to claim 30, wherein the system further comprises:

a synchronization switch situated at a desired reference point in the elevator shaft; where the calculation unit adjusts the position information of the elevator car to the position of the reference point when the elevator car triggers the synchronization switch.

37. Condition monitoring system according to claim 36, wherein the reference point is the entrance floor of the building.

38. Condition monitoring system according to claim 30, wherein the condition monitoring appliance measures the travel distances between the positions of floor stops and a reference floor, thereby developing information about floor-to-floor distances.

39. Condition monitoring system according to claim 30, wherein the system further comprises:

an error compensator that compensates for measurement error caused by misalignment of the position of the acceleration sensor before integration.

40. Condition monitoring system according to claim 30, wherein the system further comprises:

an error compensator that compensates for measurement error caused by misalignment of the position of the acceleration sensor with a compensation circuit before integration or after integration using a program.

41. Condition monitoring system according to claim 30, wherein the condition monitoring system further includes a microphone that detects acoustic signals caused by movement of the elevator car or the door of the elevator.

42. Condition monitoring system according to claim 30, wherein the condition monitoring appliance includes a measurement portion that measures the current or the voltage of a motor moving the elevator car or the door of the elevator.

43. Condition monitoring system according to claim 30, wherein the control system includes a microprocessor.

44. Condition monitoring system according to claim 30, wherein the condition monitoring appliance combines the calculated position information with a significant event or deviation in the value of a measured magnitude describing the operation of the elevator system detected by the condition monitoring system.

45. Condition monitoring system according to claim 30, wherein the acceleration sensor of the system is installed so as to be separate from the elevator system.

* * * * *

UNITED STATES PATENT AND TRADEMARK OFFICE

CERTIFICATE OF CORRECTION

PATENT NO. : 7,703,579 B2
APPLICATION NO. : 12/345331
DATED : April 27, 2010
INVENTOR(S) : Tyni et al.

It is certified that error appears in the above-identified patent and that said Letters Patent is hereby corrected as shown below:

ON THE TITLE PAGE:

Please insert the following Foreign Priority Application Data:

-- (30) Foreign Priority Application Data

Aug. 19, 2005 (FI) ..... 20050842 --.

Signed and Sealed this
Twenty-eighth Day of December, 2010

David J. Kappos

David J. Kappos
*Director of the United States Patent and Trademark Office*